United States Patent [19]

Konstant

[11] Patent Number: 5,011,031

[45] Date of Patent: Apr. 30, 1991

[54] CROSSBAR SYSTEM FOR RACK

[76] Inventor: Anthony N. Konstant, 920 Fisher La., Winnetka, Ill. 60093

[21] Appl. No.: 392,540

[22] Filed: Aug. 11, 1989

[51] Int. Cl.[5] ..... A47B 47/00

[52] U.S. Cl. ..... 211/191; 211/192

[58] Field of Search ..... 211/191, 192, 206; 108/107; 52/143, 79.5, 79.6

[56] References Cited

U.S. PATENT DOCUMENTS

| | | | |
|---|---|---|---|
| 2,815,130 | 12/1957 | Franks | 211/191 |
| 3,241,685 | 3/1966 | Shile | 211/191 |
| 3,266,635 | 8/1966 | McConnell | 211/191 |
| 3,463,325 | 8/1969 | Zagotta et al. | 211/191 |

*Primary Examiner*—Sarah A. Lechok

*Attorney, Agent, or Firm*—George H. Gerstman; Garrettson Ellis

[57] ABSTRACT

A rack which comprises a pair of parallel side beams in which each defines a groove facing the other side beam. The rack may be made by inserting between the beams at least one crossbar with the opposed ends of the crossbar each occupying a facing groove of the side beams, and with the crossbar extending between the beams. One may flex the beams outwardly as necessary to insert the crossbars. One then inserts between the beams a spacer bar, positioning the spacer bar centrally along the beam, with the opposed ends of the spacer bar each occupying a facing groove of the beam, and with the bar extending between the beams. The spacer bar is shorter than the crossbar. Thus, upon tightly securing each side beam to an end of the spacer bar, one draws a central portion of each beam inwardly relative to the crossbar or crossbars, to provide high constricting pressure securance between the ends of the crossbar and the side beams, while the spacer bar is under tension.

15 Claims, 1 Drawing Sheet

CROSSBAR SYSTEM FOR RACK

BACKGROUND FOR THE INVENTION

Warehouse storage racks and the like may be made from channel iron beams and columns, in which, typically, several levels of channel iron beams are connected to the columns to provide pairs of parallel side beams. The channels of the side beams face inwardly to receive rack-forming crossbars, which may be wooden boards having ends that fit into the channels of the side beams.

While this simple construction is commonly used for the storage of pallets in a warehouse or the like, an inconvenience can arise in that, during use, the crossbars can often slide along the channels out of position. Accordingly, this requires a continuous repositioning of the wooden crossbars in the racks.

In accordance with this invention, an improvement is provided by which the crossbars of a rack can be prevented from sliding without the inconvenience and expense of bolting them to the side beams. This is accomplished by, typically, a single, bolted member, which can tighten the entire rack after the crossbars have been positioned in a desired manner. Until the bolted member is released, there will be no sliding migration of crossbars in the structure. At the same time, the structure still retains its great simplicity of manufacture and low cost, so that it is practical for warehouse usage and the like.

Additionally, even though the ends of the crossbars fit into the channels of the side beams, or any other groove of the side beams if the side beams are of a different type, the majority of their upper surface can be made flush with the upper surface of the side beams, for ease in sliding pallets or the like onto or off the rack.

DESCRIPTION OF THE INVENTION

In this invention, a rack may be manufactured which comprises a pair of parallel, horizontal side beams, which are generally connected to vertical columns or the like. Each of the side beams define a groove facing the other side beam. Typically, channel iron beams or I-beams may be used.

In accordance with this invention, one inserts between the beams at least one crossbar, with the opposed ends of the crossbar each occupying a facing groove of the side beams, so that the crossbar extends between the beams. It may be necessary to insert the crossbars at a central position of the side beams where they can flex outwardly the most, to facilitate crossbar insertion. Then, the crossbars can be pushed by sliding into their desired position, typically away from the midpoint of each side beam.

One also inserts between the side beams a spacer bar. The spacer bar is positioned centrally along the beam, typically at about the exact center, with the opposed ends of the spacer bar each occupying a facing groove of the beams, so that the spacer bar also extends between the beams. If necessary, the beams can once again flexed outwardly to facilitate this.

By this invention, the spacer bar is shorter than the crossbar. Then, one tightly secures each side beam to an end of the spacer bar, typically by a bolt or screw. Since, the spacer bar is shorter than the crossbar, it is more loosely positioned between the side beams than the crossbar. With the screws or bolts, one thus can draw a central portion of each of the side beams inwardly relative to the crossbar, to provide high constricting pressure securance between the ends of the crossbar and the side beams. This pressure is provided with a corresponding tension applied to the spacer bar. Because of this high constricting pressure, the crossbars present become immovable, providing a rigid rack system with just typically a single, bolted spacer bar between each pair of beams.

Preferably, the crossbars are spaced by at least a foot from the spacer bar, to provide a free length of side beam adjacent the spacer bar which can flex inwardly to accomplish the purposes of this invention.

It is also preferred for the crossbar or crossbars to have ends which are of reduced thickness relative to their central portions. Thus, the upper surfaces of the side beams may be placed substantially coplanar relation with the upper surface of the crossbar when inserted into the grooves of the side beams. The ends of reduced thickness may constitute an end having a bevelled or slanted portion, a rectangular cutaway or notched portion, or the like.

Thus, by this invention, a simple expedient provides a rigid, inexpensive rack which makes use of principles of counterbalancing compression and tension, to provide significantly improved performance over corresponding racks of the prior art.

DESCRIPTION OF SPECIFIC EMBODIMENTS

Figure 1:
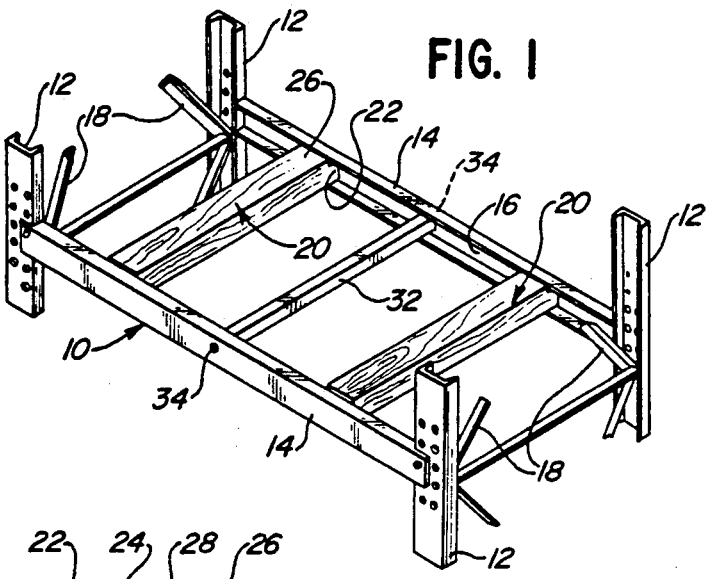
FIG. 1 is a perspective view of a rack in accordance with this invention.

Referring to the drawings, rack 10 is disclosed, shown to be part of a multiple level rack for a warehouse.

As is conventional, four channel iron columns 12 stand vertically, and are bolted to the respective ends of side beams 14, which are also channel iron sections in which the channels 16 face inwardly toward each other.

Added angle iron sections 18 are provided in conventional manner for structural support of the multiple level rack.

Figure 4:
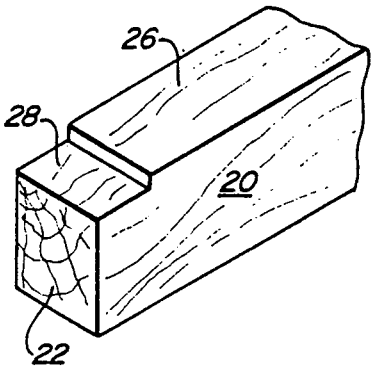
FIGS. 4 and 5 are enlarged, fragmentary perspective views of the ends of different types of wooden crossbars which may be used in accordance with this invention.
Figure 3:
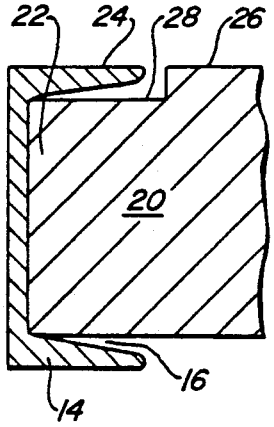
FIG. 3 is an enlarged, sectional view taken along line 3—3 of FIG. 2.
Figure 5:
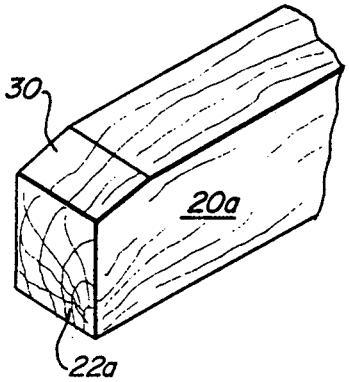
Figure 2:
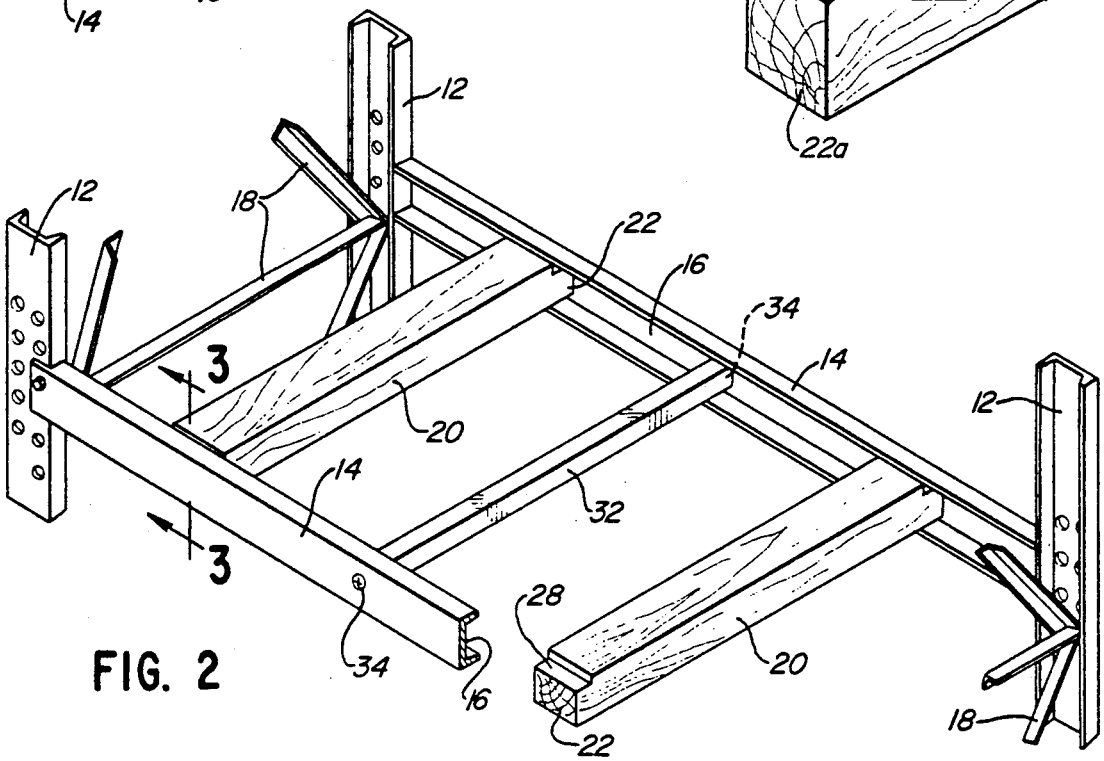
FIG. 2 is an enlarged, perspective view of the rack of FIG. 1, with portions broken away.

Rack 10 carries a pair of wooden crossbars 20, having ends 22 which respectively fit into channel 16 of the crossbar 14 that the end engages, to secure crossbars 20 in the channels. As shown particularly in FIG. 3, end 22 of crossbar 20 may be of reduced thickness relative to its central portions, being proportioned so that the reduced-thickness ends 22 may snugly fit within channels 16 of side beam 14, while the upper surfaces 24 of each of side beams 14 may be substantially coplanar with the upper surfaces 26 of each crossbar 20. As shown in FIG. 4, this may be done by providing a simple notch 28 at each end of the crossbar. Alternatively, as shown in FIG. 5, a different crossbar **20*a* may define a bevel 30 at end 22*a***, to accomplish a similar purpose.

Rack 10 also includes a spacer bar 32, which may be a metal rod of square or round cross-section, having a screw-threaded aperture at each end. Bar 32 connects at each end with a side beam 14, being bolted to each side beam by means of one or more bolts 34, so that, typically, spacer bar 32 is in tension, urging side beams 14 inwardly. Crossbars 20 typically have a length that is slightly greater than the width of the outer walls of side beams 14 by about a quarter inch or so, for a normally sized rack in which the crossbars are on the order of 38 inches apart and the length of beams 14 is on the order of 72 inches or more. Thus, the presence of crossbars 20 tends to cause side beams to bow outwardly to slight degree. Then, spacer bar 32 draws central portions of side beams 14 inwardly, resulting in a significant increase in the compression on crossbars 20 as the tension on spacer bar 32 is increased by the tightening of screws or bolts 34.

By this means, a tight, rigid rack can be provided, where the frictionally secured crossbars 20 are held in tight compression, and remain rigidly secure throughout their useful life.

Side beams 14 may be 3 inch standard beams. While crossbars 20 maybe about a quarter inch longer than the unstressed width of side beams 16 as mounted on columns 12, spacer bar 32 typically has a length that substantially corresponds to the width between side beams 16, as measured from their vertical walls. If desired, spacer bar 32 may have a length that is slightly less than such a width of the side beams, to increase the tension imposed on spacer bar 32 and the corresponding compression imposed on cross bars 20. Alternatively, crossbars 20 may have a length which generally corresponds to the width of side beams 16, as measured from their vertical walls. Spacer bar 32 may be shorter than crossbars 20 and the width between side beams 14, so that side beams 14 may be drawn inwardly by connection with spacer bar 32, to place spacer bar 32 in tension and crossbars 20 in compression, to lock the crossbars 20 in place.

The above has been offered for illustrative purposes only, and is not intended to limit the scope of the invention of this application, which is as defined in the claims below.

That which is claimed is:

1. A method of manufacturing a rack which comprises a pair of parallel side beams, each defining a groove facing the other side beam, which method comprises:

inserting between said side beams a crossbar with the opposed ends of said crossbar each occupying a side beam facing groove, to extend between said side beams, while flexing said side beams outwardly for said insertion; inserting between said side beams a spacer bar positioned along a central portion of said side beams, said spacer bar having opposed ends and being shorter than said crossbar; and tightly securing each said side beam to one of said opposed ends of said spacer bar to draw said central portion of each said side beam inwardly relative to said crossbar, to provide high constricting pressure securance between the ends of said crossbar and the side beams.

2. The method of claim 1 in which said side beams comprise inwardly-facing channel iron members.

3. The method of claim 2 in which said crossbar has opposed ends which are of reduced thickness relative to central portions of said crossbar, and in which the side beams and crossbar each have an upper surface whereby the upper surfaces of said side beams are substantially coplanar with the upper surface of said inserted crossbar.

4. The method of claim 1 in which a plurality of said crossbars are inserted between said side beams, said crossbars being spaced from the spacer bar by at least 1 foot.

5. A rack which comprises a pair of parallel side beams, each side beam defining a groove facing the other side beam; a crossbar having opposed ends, the opposed ends of said crossbar each occupying a facing groove of the side beams to extend between said side beams; a spacer bar inserted between said side beams at a central location thereof, said spacer bar having opposed ends and extending between said side beams, said spacer bar being shorter than said crossbar and secured at each opposed end to a side beam under tension, to urge a central portion of each side beam inwardly relative to said crossbar, whereby said crossbar is under high compression securance between said side beams.

6. The rack of claim 5 in which said side beams are carried at their ends by vertical columns.

7. The rack of claim 5 in which said side beams comprise inwardly-facing channel iron members.

8. The rack of claim 7 in which said crossbar has ends which are of reduced thickness relative to central portions of said crossbar, whereby the upper surfaces of said side beams are substantially coplanar with the upper surface of said crossbar.

9. The rack of claim 8 in which a plurality of said crossbars are inserted between said side beams, said crossbars being spaced from the spacer bar by at least 1 foot.

10. The rack of claim 5 in which a plurality of said crossbars are inserted between said side beams, said crossbars being spaced from the spacer bar by at least 1 foot.

11. The rack of claim 5 in which said crossbar has ends which are of reduced thickness relative to central portions of said crossbar, whereby the upper surfaces of said side beams are substantially coplanar with the upper surfaces of said crossbar.

12. A rack which comprises a pair of parallel side beams, each defining a groove facing the other side beam, and a plurality of crossbars, each of said crossbars having opposed ends, said opposed ends each occupying said facing groove of the side beams with the crossbars extending between said side beams, said crossbars having ends which are of reduced thickness relative to central portions of said crossbar, whereby the upper surfaces of said side beams are substantially coplanar with the upper surfaces of said crossbars; a spacer bar positioned centrally along said beam, spaced from said crossbars, said spacer bar extending between said side beams, said spacer bar being shorter than said crossbars, the ends of said spacer bar being tightly secured to each respective side beam to draw a central portion of each side beam inwardly relative to said crossbars to place said spacer bar under tension, and to provide high constricting pressure securance between the ends of said crossbars and the side beams.

13. The rack of claim 12 in which said crossbars are spaced from the spacer bar by at least 1 foot.

14. The rack of claim 13 in which said side beams comprise inwardly-facing channel iron members.

15. The rack of claim 14 in which said side beams are attached at their ends to vertical columns.

* * * * *